US007721570B2

(12) United States Patent
Lawrence

(10) Patent No.: US 7,721,570 B2
(45) Date of Patent: May 25, 2010

(54) PRIMARY SPACER EMBLEMATIC FOR A GOLF BALL MARKER

(76) Inventor: Lonnie L. Lawrence, 1024 N. County Rd. W., Odessa, TX (US) 79763

( * ) Notice: Subject to any disclaimer, the term of this patent is extended or adjusted under 35 U.S.C. 154(b) by 792 days.

(21) Appl. No.: 11/426,405

(22) Filed: Jun. 26, 2006

(65) Prior Publication Data

US 2006/0248687 A1 Nov. 9, 2006

Related U.S. Application Data

(63) Continuation-in-part of application No. 10/977,721, filed on Oct. 29, 2004, now abandoned.

(60) Provisional application No. 60/515,800, filed on Oct. 29, 2003.

(51) Int. Cl.

| | |
|---|---|
| ***A44C 13/00*** | (2006.01) |
| ***A44C 1/00*** | (2006.01) |
| ***A44C 25/00*** | (2006.01) |
| ***A45F 5/00*** | (2006.01) |

(52) U.S. Cl. ..... 63/1.16; 63/40; 63/20; 63/1.11; 224/269

(58) Field of Classification Search ..... 63/1.11, 63/1.16, 20, 40; 224/269
See application file for complete search history.

(56) References Cited

U.S. PATENT DOCUMENTS

| | | | | |
|---|---|---|---|---|
| 4,475,676 | A * | 10/1984 | Smith | 224/247 |
| 4,530,500 | A * | 7/1985 | Kaymen | 473/406 |
| D301,286 | S * | 5/1989 | Hird | D3/221 |
| 2001/0016526 | A1 * | 8/2001 | Tate | 473/406 |
| 2002/0034992 | A1 * | 3/2002 | Tate | 473/406 |

* cited by examiner

*Primary Examiner*—Victor Batson
*Assistant Examiner*—David Reese
(74) *Attorney, Agent, or Firm*—Law Office of Tim Cook P.C.

(57) ABSTRACT

An ornamental device comprising a primary rigid plate with a space between the primary rigid plate and the surface of an object such as an article of clothing or cap, the space providing a receptacle to releasably hold a secondary rigid ball marker either frictionally or magnetically held, the device further being able to accommodate a secondary ball marker on top.

6 Claims, 4 Drawing Sheets

PRIMARY SPACER EMBLEMATIC FOR A GOLF BALL MARKER

This application is a Continuation in Part of U.S. application Ser. No. 10/977,721 filed Oct. 29, 2004, now abandoned, which claims priority from Provisional U.S. Patent Application Ser. No. 60/515,800 filed Oct. 29, 2003.

BACKGROUND OF THE INVENTION

1. Field of the Invention

The present invention relates generally to the field of emblematics, and more particularly to the creation of a space or void between a primary rigid plate and the surface of an object it attaches to, to accommodate a secondary rigid ball marker plate sandwiched between the primary rigid plate and the object's surface to form a dual emblematic.

2. Description of Prior Art

Various ways to make emblematics have existed for years. As used herein, the term "emblematic" refers to any article of manufacture which displays a company or official logo, school identifier, or event, or other type of esthetic image for example. Distinguishing characteristics of emblematics typically include a fairly small and rigid surface plate providing space for a motif, the plate being typically made out of one or more of a myriad of plastics or metals of sufficient property to render a design thereon intended to display an insignia, logo, crest, or design. Emblematics are commonly used for such items as lapel pins, refrigerator magnet indicia, badges of rank. Emblematics can be attached to key chains, necklaces, bracelets, drinking glasses, cigarette lighters, money clips, belts, belt buckles, cars, or almost any surface intended to display a message or recognizable image. The primary function of the emblematic is to display a message or graphic design via the manufacturing process of casting, stamping, or printing on a rigid material.

The emblematic may or may not have a fastening mechanism to attach to another object; for instance, a coin is an emblematic which typically does not include a mechanism to fasten the coin to another object. For the most part however, emblematics have a fastening mechanism. The fastening mechanism could be any type of pin, hook, clutch, magnet, snap, glue, or similar mechanism. Nevertheless, such mechanism all serve to attach the emblematic. Hence, such fastening mechanisms are not new art and are included in the present disclosure for demonstration purposes and as such, all such methods of fastening are considered included in prior art.

In current or prior art, there are no known emblematics that have the significant advantage of having a primary rigid plate with space provided behind the primary rigid plate to hold a second emblematic; two wholly separate, complete and independent emblems that when combined form an expanded display revealing new information not contained in the emblematics used separately. Such dual emblematics by addition reveal a new message to the user by combining two emblematics forming larger indicia and a new picture. Thus, in a first aspect, the present invention provides a main or primary emblem with a unique space provided on the back of the emblem to accommodate a second emblematic of different sizes and shapes.

Focusing in more closely to the present disclosure, golf ball markers are one specific instance of a common emblematic. Golf ball markers are used either individually by themselves or as attached to another emblematic or surface such as a fabric. The golf ball marker can attach to a primary rigid plate that serves as a holder, as is the case of a divot fixer, or as in the case of a hat bill it can attach to the surface of the fabric. The most common method of attachment of a golf ball marker to a cap's surface is a magnet affixed to the golf ball marker. The magnet then is attracted to a ferrous surface either attached on top of or under the fabric surface. The most common method of attachment of a golf ball marker to another emblematic such as a divot fixer is also a magnet, but usually the magnet is in the primary rigid plate, not the golf ball marker.

In the art, no hint or reference has been contemplated of placing a golf ball marker behind another emblematic with a space provided to accommodate such a secondary rigid ball marker plate. No such primary rigid plate exists that can accommodate a secondary rigid ball marker plate that can slide behind a primary rigid plate via a space provided between the primary rigid plate and the surface of another object, but rather all present art attaches to the front of an emblematic holding device or surface of an object. Golf ball markers that attach to the front of a primary rigid plate hide part of the main emblematic design, thus hiding the main logo of the end user, or, as is the case with all other primary golf ball holder type emblematics such as a divot fixer, they have an unsightly void in the front when the golf ball marker is removed.

In all instances, even if the holder type is decorative under the marker, the front design of the holder is hidden when the ball marker is attached. The present disclosure can also hold many different sizes and shapes of secondary rigid ball marker plates behind the primary rigid plate without compromising the integrity of the piece whereas the holder with a void type cannot. The fastening mechanisms of the above mentioned golf ball markers and emblematic holders are primarily the magnetic type, but the fastening mechanism is not new to the art; the second emblematic sandwiched behind the primary rigid plate and the surface of an object is new to the art. The primary rigid plates of prior art may have a complete design, but the design on the primary or main emblematic is hidden under the second design of the golf ball marker thus subtracting from the overall message of the primary or main emblem, creating a lesser picture of the primary emblem, not more, and likewise less attractive.

Furthermore, tabs or tassels which can come in the form of ribbon tabs, rocker tabs, and bars, which hang from a primary rigid plate such as a lapel pin or the like do create a bigger picture, but are not readily removable to be used as a golf ball marker as the present disclosure affords and do not reside behind the primary rigid plate. Such tabs and the like are not stand alone emblematics either. They have unsightly holes or chain links and must be cumbersomely removed from the primary rigid plate. Thus, even though the tabs or tassels seemingly address the concept of installing an irregular shaped secondary rigid ball marker plate beside the primary rigid plate to create a bigger picture, the tabs or tassels are not a complete, separate and independent emblematic and are not readily removable and do not reside behind the primary rigid plate. The concept of being easily removable is lost and thus cannot be used as a golf ball marker holder as the present disclosure can. The lack of such a feature is commercially unattractive.

The present disclosure combines a secondary rigid ball marker plate "piggy backed" to the back of a primary rigid plate to create a somewhat bigger picture or message, for the secondary rigid ball marker plate is not completely hidden, thus being partially exposed, is readily removable to be used independently from the primary rigid plate.

Furthermore, if the secondary rigid ball marker plate behind the primary rigid plate is lost, the primary rigid plate does not become useless, but rather still displays its intended message regardless of the second emblematic. Continuing on in the advantages of the present disclosure, any new object with sufficient characteristics may be substituted into the space between the primary rigid plate and surface of an object the primary rigid plate is attached to. For instance, the space can accommodate an ordinary coin in so much as the coin is thick enough to fill the space and be frictionally held in place. No such art exists today, not even a golf ball marker and its holder, or tabs and tassels with a primary lapel pin type emblematic. No such current art alludes to such a concept because all current art are a primary rigid plate or object surface with an emblematic attached in front of the primary rigid plate or object surface. There is no such space as to frictionally hold an object such as a coin and no such primary rigid plates with a space for a secondary rigid ball marker plate between the primary rigid plate and the surface of an object the primary rigid plate is attached to, and finally there is no such primary rigid plate where the secondary rigid ball marker plate behind the primary rigid plate is readily removable to use as a golf ball marker, however, the secondary rigid ball marker plate does not necessarily have to be used as a golf ball marker. It can be used to simply portray a larger message.

The present invention includes certain criteria, namely, two unconnected, independent, and separate emblematics being readily and releasably combined, never hiding the main emblematic in any way to create a better larger message. Furthermore as previously stated such a concept opens the possibilities for a primary rigid plate to hold a coin or favorite lucky token of some type sandwiched between the primary rigid plate and the surface of an object the primary rigid plate is attached to, or additionally hold any type object that would render itself to be slid into the space, pocket or slot behind the main emblem and the surface of an object the primary rigid plate is attached to. Such concept is described in detail in the details section of the present application.

The space, pocket or slot on the back the main or primary rigid plate has major cost advantages as well when making emblematics. One primary emblem can be made for one company or school or event accompanied by many secondary rigid ball marker plates of regular or irregular sizes and shapes which cost much less. The two combined emblematics make up a myriad of different emblematics for one entity. Costs are significantly reduced for the manufacturer and thus for the end user. Secondary rigid ball marker plates may or may not be used as golf ball markers when combining emblematics may for general purpose be used primarily to display or convey a message, not a golf ball marker. For instance, a school might want the name of the school as the primary rigid plate and then use a secondary rigid ball marker plate, say a football, basketball, or baseball to promote an event or a seasonal sport, all interchangeable depending upon the season or time of event. The primary rigid plate can look good all by itself without the secondary rigid ball marker plates, but addition of the secondary rigid ball marker plate adds to the specificity of the sport or event at hand. Finally, the secondary rigid ball marker plate can be all sizes and irregular shapes and, as in the case of the situation when the secondary rigid ball marker plate is a ball marker, if the ball marker is lost, an alternative object such as a coin or favorite or lucky token can be put in its place. Nothing in present art addresses all the aforementioned advantages and all are primarily for golf ball marker use and with substantially a "round" ball marker.

Many types of emblematics holding a secondary rigid ball marker plate exist in current art. For example, U.S. Pat. No. 6,422,955 issued to Lopez shows a golf ball marker holding device for use by a golfer that includes a top surface formed from a ferrous material, and having a low rim formed thereon and a rear surface having a pin secured thereto. A resilient, magnetic disk ball marker is held in a cavity defined by the low rim and the top surface, and is easily removed from the cavity to mark the location of a removed golf ball. The pin is secured in an article of clothing, and a butterfly-like clip is secured to the free end of the pin to hold the device to the article of clothing.

U.S. Pat. No. 6,569,039 issued to Cope is a golf ball position marking assembly that includes a marker removably secured to a decorative or functional accessory item such as a ring, pendant, clip, belt, key ring, bracelet, buckle, divot tool, or the like. The marker is magnetically secured to a base in such a way that a golfer can quickly and easily detach it to mark the position of a golf ball, and as easily re-attach it when the time comes to play. The assembly is made of any suitable material, including plastics, metals, ceramics, and composites. If desired, it can include decorative or functional indicia such as precious stones, decorative etching or enameled ornamentation, the user's name or initials, memorable dates, advertising material, tournament logos, or golf club logos.

U.S. Pat. No. 6,170,088 issued to Tate is a ferrous object attached to or embedded within an article of golf clothing so that it is subject to the force of magnetic attraction of a magnet in a ball marker. A magnetic ball marker according to the invention has a body that can be stamped, painted, machined, or otherwise provided with surface embellishments, such as tournament logos, golf course crests, corporate logos, and other visual indicia that are favored by golfers. Unlike conventional golf ball markers, however, a ball marker according to the invention is provided with a thin, flat, permanent magnet that is attached to or embedded within the body of the ball marker. When the ball marker is moved into the proximity of an article of golf clothing modified according to the invention by the incorporation of a ferrous object therein, the ball marker will be attracted to the ferrous object and will cling to the article of golf clothing until purposely removed therefrom. The invention has particular applicability to golf headgear, such a hats and visors. The ferrous objects employed may be configured as thin metal sheets, discs, wafers, or strips attached to or embedded within the bill or a golf hat or visor. The magnet ball marker of the invention is then simply placed in contact with or even in near proximity to the area of the hat at which the ferrous object has been permanently attached. The magnetic ball marker will thereupon cling to the article of golf clothing until removed therefrom for use.

Thus, many different devices exist in prior art for making an emblematic that holds a secondary rigid ball marker plate, yet none addresses the significant and major advantages of the present disclosure. For example, no primary rigid plates in the art allow a secondary rigid ball marker plate to be sandwiched behind the primary rigid plate and in front of the surface of an object the primary rigid plate is attached to. This type of process, technique, method of manufacturing or technology has not been developed and has major cost advantages when making emblematics.

SUMMARY OF THE INVENTION

It is therefore an object of this invention to provide a primary rigid plate with a space between the primary rigid plate and the surface of an object the primary rigid plate is attached to, the space provided to hold a secondary rigid ball marker plate and frictionally or magnetically grip a secondary rigid ball marker plate.

It is therefore a further object of this invention to provide a primary rigid plate with a space between the primary rigid plate and the surface of an object the primary rigid plate is attached to, to display multiple events via the space holding any one of a multiple secondary rigid ball marker plates, with or without the use of a magnet.

It is another object of this invention to provide a primary rigid plate with a space between the primary rigid plate and the surface of an object the primary rigid plate is attached to, the space providing for secondary rigid ball marker plates with different sizes.

It is therefore an object of this invention to provide a primary rigid plate with a space between the primary rigid plate and the surface of an object the primary rigid plate is attached to, to display multiple events and messages for one entity made of inexpensive material such as plastic.

It is therefore an object of this invention to provide a primary rigid plate with a space between the primary rigid plate and the surface of an object the primary rigid plate is attached to, to provide a primary rigid plate that when no secondary rigid ball marker plate is inserted, still is attractive and complete by itself.

It is therefore an object of this invention to provide a primary rigid plate with a space between the primary rigid plate and the surface of an object the primary rigid plate is attached to, the space providing for a secondary rigid ball marker plate such as a coin, token or other object.

It is therefore an object of this invention to provide a primary rigid plate with a space between the primary rigid plate and the surface of an object the primary rigid plate is attached to, to provide a primary rigid plate that can hold an irregular shaped secondary rigid ball marker plate.

It is therefore an object of this invention to provide a primary rigid plate with a space between the primary rigid plate and the surface of an object the primary rigid plate is attached to, the space providing for a secondary rigid ball marker plate a secondary rigid ball marker plate that is readily removable.

It is therefore an object of this invention to provide a primary rigid plate with a space between the primary rigid plate and the surface of an object the primary rigid plate is attached to, to provide a primary rigid plate that can hold an irregular sized and shaped secondary rigid ball marker plate that is readily removable and interchangeable with other sizes and shapes of secondary rigid ball marker plates.

It is therefore an object of this invention to provide a primary rigid plate with a space between the primary rigid plate and the surface of an object the primary rigid plate is attached to, the space providing for a secondary rigid ball marker plate that is much less expensive compared to the primary rigid plate.

It is therefore an object of this invention to provide a primary rigid plate with a space between the primary rigid plate and the surface of an object the primary rigid plate is attached to, that is used for advertising.

It is therefore an object of this invention to provide a primary rigid plate with a space between the primary rigid plate and the surface of an object the primary rigid plate is attached to, the space providing for a secondary rigid ball marker plate that is imprintable on both sides.

DETAILED DESCRIPTION OF PREFERRED EMBODIMENTS

Figure 1:
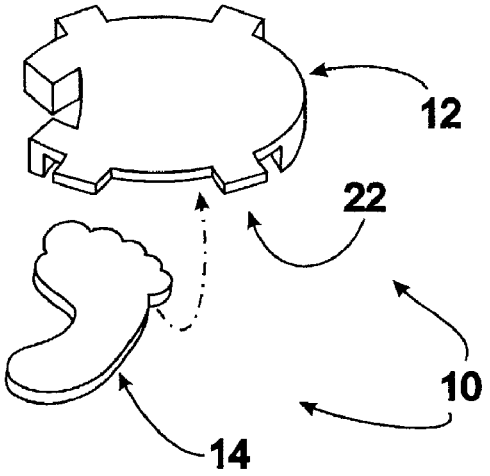
FIG. 1 is a perspective view of a primary rigid plate with a void or space underneath the primary rigid plate, a dotted line and arrow indicating the direction and place of insertion of a secondary rigid ball marker plate with respect to the primary rigid plate void or space.
Figure 2:
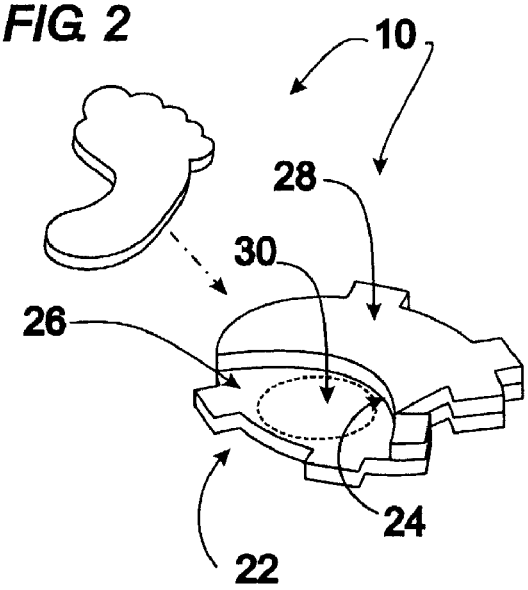
FIG. 2 is a detail view of the back of a primary rigid plate with a void or space of a primary rigid plate, a dotted line and arrow indicating the direction and place of insertion of a secondary rigid ball marker plate and revealing a magnet as one preferred method of fastening.
Figure 3:
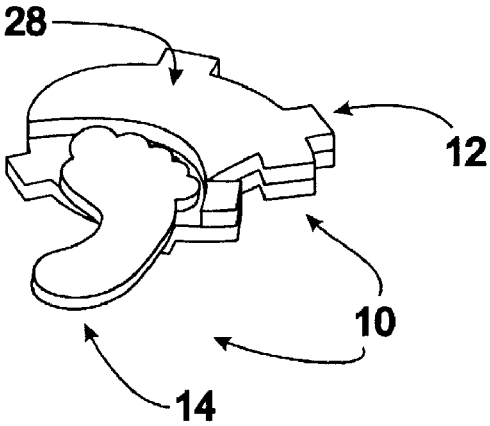
FIG. 3 is a perspective view of the back side of a primary rigid plate with a void or space, the secondary rigid ball marker plate attached to the void or space.

FIGS. 1 through 6 depict a presently preferred embodiment of an ornamental display for combining a primary and secondary rigid ball marker plate and the resultant device 10 of the present invention. The device 10 preferably comprises a non-ferrous primary rigid plate 12 with a secondary rigid ball marker plate 14 placed behind the primary rigid plate 12 forming a combined ornamental piece, the device 10.

The ornamental display formed by combining a primary and secondary rigid ball marker plate and the resultant device 10 of the present invention are preferably cast, molded, cut, or stamped units made out of metal or plastic material or blended metal alloys or family of plastics thereof that lend themselves to a stiff but resilient property for stamping, molding, bending and cutting ease. Many other materials could lend themselves to such resiliency properties of casting, molding, bending, stamping and cutting ease and although metal is preferred, the material used should not limit the scope of the invention. For example, the device may be made of flexible metal, flexible alloy, flexible polymer, polyolefins, polyamides, polyethylene, polypropylene, and copolymers and terpolymers thereof, or rubbery polymer.

While the manufacture of the ornamental device 10 by combining a primary rigid plate 12 and secondary rigid ball marker plate 14 and the resultant device 10 of the present invention by a multi-step process of using material of a particular stock, that is subsequently cast, molded, stamped, bent or cut is preferred, it can also be appreciated that the ornamental device 10 by combining a primary rigid plate 12 and secondary rigid ball marker plate 14 and the resultant device 10 of the present invention can also be thermoformed or stamped or a combination thereof, such as is the case with a corrugated carbide fiber plastic or other similar plastic or nylon raw materials and such materials are also well within the scope of the present invention.

The ornamental device 10 by combining a primary rigid plate 12 and secondary rigid ball marker plate 14 and the resultant device 10 of the present invention show a particular embodiment of the device 10 that preferably comprises two substantially flat plate-like three dimensional objects in FIGS. 1-6 with a length, height, and thickness, the primary rigid plate 12 having a secondary wall 24 and surface 26 of sufficient depth, length and height to define a space, a void, or a cavity 22 in the primary rigid plate 12 where a secondary rigid ball marker plate 14 may be inserted and held, thus rendering a structure comprising a combination of two emblematics to form a greater picture where combining a primary rigid plate 12 and secondary rigid ball marker plate 14 is additive whereas separated they display two separate yet complete pictures.

Figure 4:
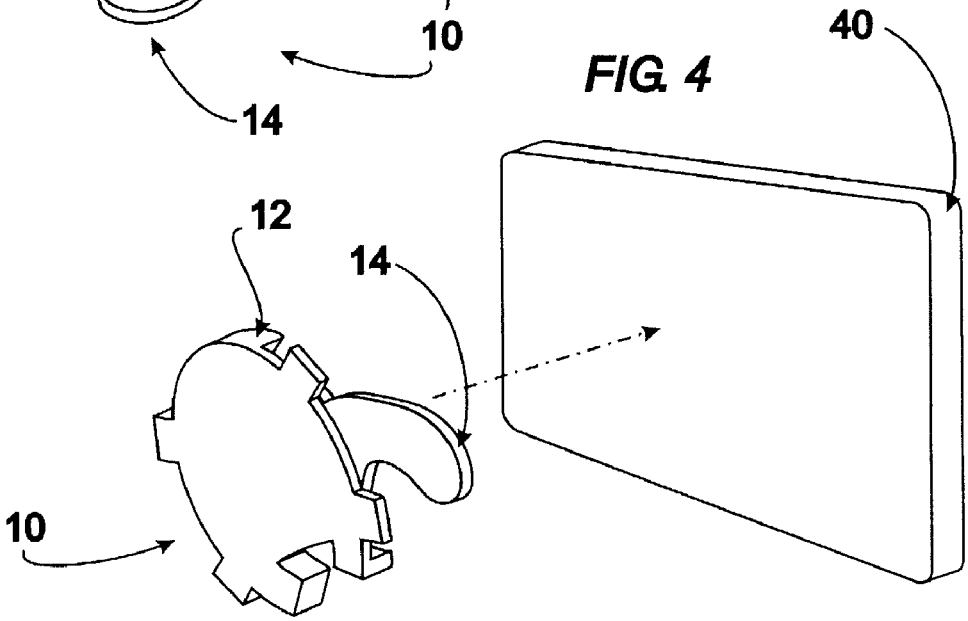
FIG. 4 is a perspective view depicting a primary rigid plate with a void or space filled with a secondary rigid ball marker plate.
Figure 5:
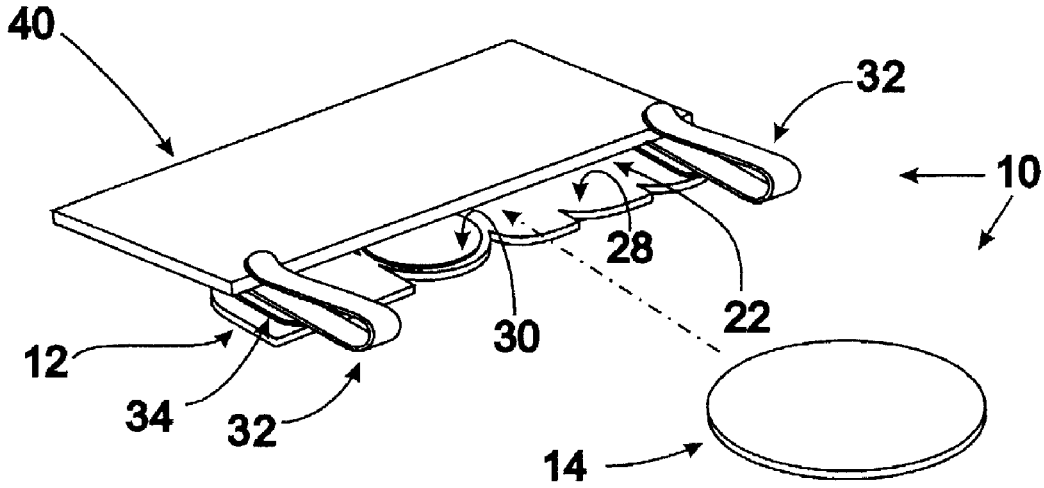
FIG. 5 is a perspective view of a primary rigid plate turned on its face revealing two spring clips and a magnet.
Figure 6:
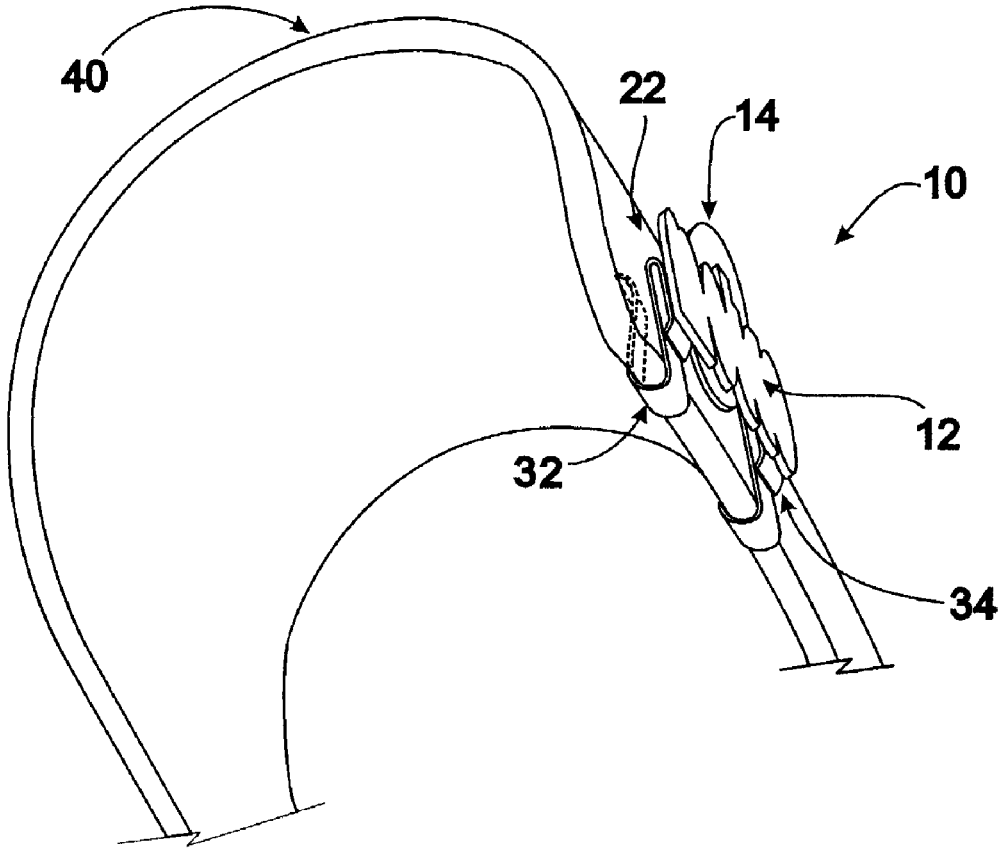
FIG. 6 is a perspective view showing the primary rigid plate attached to an object surface.

According to this particular preferred embodiment of the invention, the space, void, or cavity 22 allows the insertion of a secondary rigid ball marker plate 14 and thus the space, void, or cavity 22 is defined by the inner wall 24 and the surface 26 that is formed or hollowed out of roughly less than half a portion of a back side 28 of the primary rigid plate 12 in FIGS. 1-6. It consequently forms the surface 26 with a thickness thinner than the thickness of the over-all thickness of the primary rigid plate 12. This structure yields the space, void, or cavity 22. In FIGS. 5 and 6, it can be appreciated that such a void can be defined by any type spacer that can lift the back of the primary rigid plate 12 far enough away from the surface of an object to allow for the insertion of a secondary rigid ball marker plate 14 and that such a void may simply be defined by a spacer, in this case two spring clips 32 attached to the back of the primary rigid plate with sufficient thickness at 34 on the back of the primary rigid plate as to create the space 22 between the primary rigid plate and the surface the primary rigid plate is attached to, and not a hollowed out void or cavity defined by an inner wall 24 and surface 26 as shown in FIGS. 1-4 that is formed or hollowed out of roughly less than half a portion of the back side 28 of the primary rigid plate 12 in FIGS. 1-4. Alternatively, the clips may instead be a single clip, and alternatively the clip may be integrally molded or otherwise formed with the primary rigid plate. Such a spacer 22 in FIGS. 5-6, whether part of a spring clip 34 or just a raised nodule or bump on the back surface of the primary rigid plate should be of sufficient enough thickness to lift the back of the emblem away from the surface of the object 40, or any such spacer method as would lift the back of the primary rigid plate 12 away from the surface of the object 40, and such types of spacer should not limit the scope of the present invention.

The width, height and depth of the void or cavity 22 in FIGS. 1-6 with a fastening mechanism 30, in this case, a small round magnet, is large enough to insert and hold the secondary rigid ball marker plate 14 in place against a reasonable jolt or force as might be experienced during any particular use by the user, yet readily releasable enough to permit the constant removal and reinsertion of the ornamental secondary rigid ball marker plate 14 from and back onto the fastening mechanism 30 as needed. The size of the void or cavity 22, defined by an inner wall 24 and surface 26 in FIGS. 1-4 may be such that "one size fits all" so as to accommodate irregular shaped as well as substantially rounded secondary rigid ball marker plates 14, and such inner wall 24 may not exist at all and surface 26 would then be surface 28 the back of the emblematic 12 with no wall defining a void, rather any type spacer 34 of spring clips 32 or any other type of spacers would lift the back of the emblematic 12 far enough away from the surface of the object 40 as to allow for insertion of a secondary rigid ball marker plate 14.

Considering the many different variables of cuts and shapes of secondary rigid ball marker plates 14 and the many different types of fastening mechanisms available, the ornamental fastening mechanism 30 in FIGS. 1-6 are conveniently shown as a round thin magnet fastening mechanism inset onto surface 26, and is only one preferred embodiment of many different types of fastening mechanisms capable of gripping the secondary rigid ball marker plate 14 surface including frictional nodules, spring clips, and Velcro® inside the void 22 and can work in conjunction with a magnet as well. The ornamental primary rigid plate 12 of FIGS. 1-6 provide for attachment of many different styles and shapes of secondary rigid ball marker plates 14, here shown as a small foot print. Considering the scope of the invention, many designs are capable of attaching to the primary rigid plate 12 and become part of the function of the ornamental device 10 forming a combined picture or display such as having a primary rigid plate 12 displaying a name of a school while the secondary rigid ball marker plate 14 displays a football, or a number, or a figurine and thus forming a combined picture greater than the pieces individually could display.

A preferred embodiment of the ornamental device 10 is to mount the ornamental device 10 onto a baseball cap type visor shown as a flat surface object 40 of FIGS. 4-5 and in more detail in FIG. 6, but just as well could be an article of clothing or any other myriad of surfaces that would yield favorably to the usefulness of the invention disclosed. By attaching to the ornamental device 10 to a baseball cap type visor surface 40, shown in FIGS. 4-6, the user can readily remove and interchange the secondary rigid ball marker plate 14 with other secondary rigid ball marker plates 14 by grasping with a finger and slipping the secondary rigid ball marker plate 14 out of the primary rigid plate 12 and thus change the display into a new and different display without removing the primary rigid plate 12 from the surface object 40. The secondary rigid ball marker plate 14 is so lodged between the surface of the object 40 and the primary rigid plate that the secondary rigid ball marker plate 14 is readily removable and interchangeable.

Although the ornamental device 10 in FIGS. 1-4 is shown as having an inner wall 24 and surface 26 as being primarily a void or cavity 22 shaped like a half moon, the inner wall 24 and surface 26 may be other shapes and have other fastening mechanisms 30, yet have similar function as the present disclosure, and should not limit in scope the disclosed significant advantages of the invention.

The ornamental device 10 with primary rigid plate 12 and secondary rigid ball marker plate 14 can be packaged for resale as a single unit, or, the primary rigid plate 12 and secondary rigid ball marker plate 14 individually. They can then be shipped as either as a combined unit or as components to the retail outlets as a finished product or distributors as a promotional product.

Figure 7:
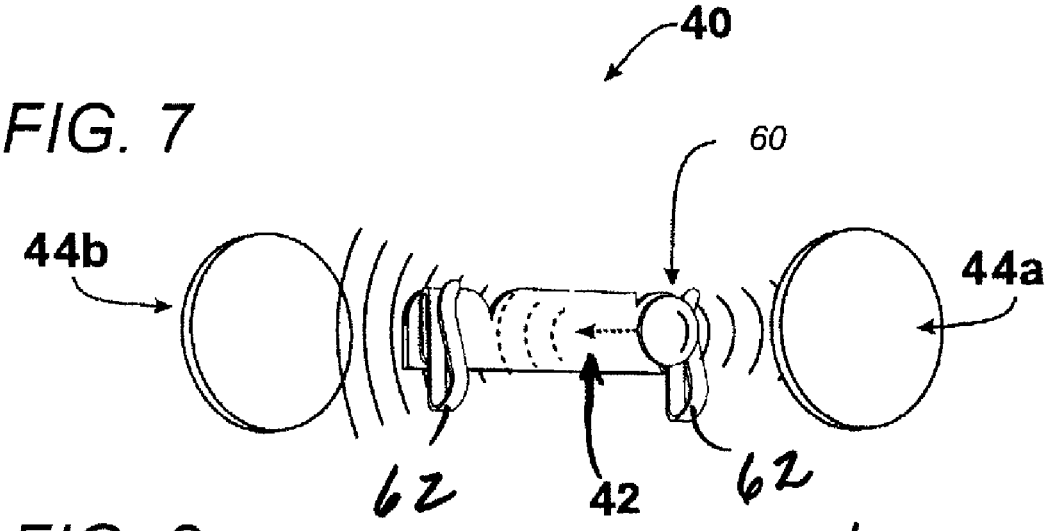
FIG. 7 is a perspective rear view of a preferred embodiment of a ball marker retainer.
Figure 8:
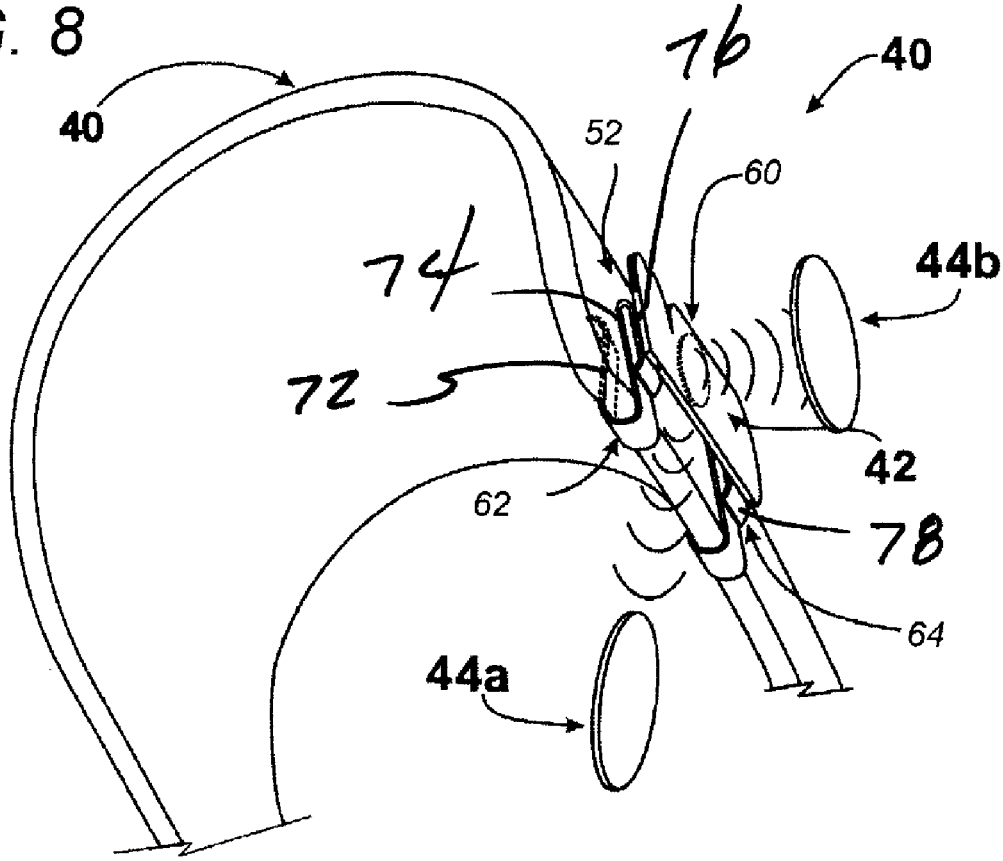
FIG. 8 is a perspective view of the ball marker retainer of FIG. 7 attached to the bill of a cap.
Figure 9:
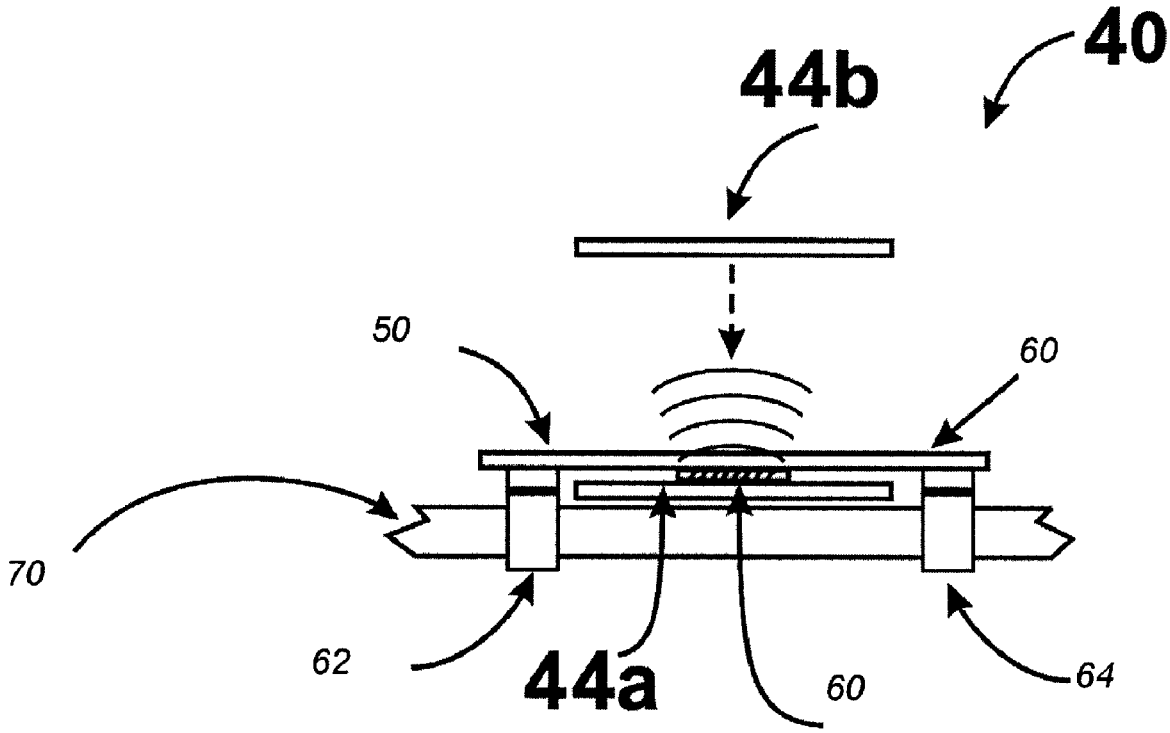
FIG. 9 is a top view of the ball marker retainer of FIG. 7.

FIGS. 7 through 9 depict another presently preferred embodiment of the present invention of a ball marker retainer 40. The retainer 40 comprises primarily a plate 42 with a pair of clips 62 oriented to clips onto a cap bill 70. A permanent magnet 60 is affixed to the plate 42, preferably on an inside surface 61 (See FIG. 9) of the plate. The permanent magnet has adequate strength to retain a ball marker 44*a* placed adjacent to the inside surface 61 of the plate and also has adequate strength to retain a ball marker 44*b* placed adjacent to an outside surface 63 of the plate. It should also be noted that the space 34 is selected such that a non-ferrous ball marker may also be frictionally retained between the plate and magnet and the outside surface of the ball cap bill.

Now note the structure of one of the clips 62. The clips is formed of three layers or leaves, wherein a first leaf 72 extends underneath and behind the bill 70 when the retainer 40 is installed. A second leaf 74 is contiguous with the first leaf and is in abutting contact with the bill 70 when the retainer is stalled. Finally, a third leaf 76 is contiguous with the second leaf and extends substantially parallel with the second leaf. A tab 78 extends from the third leaf and abuts the second leaf, thereby defining a space 64 between the bill 70 and the plate 42.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

I claim:

1. A ball marker retainer adapted to hold ball markers on multiple surfaces and further adapted to be releasably mounted on the bill of a ball cap, the retainer comprising:

a. a non-ferrous primary plate defining a primary emblematic, the primary plate defining an inside surface and outside surface relative to the surface of the bill of the ball cap;

b. first and second ferrous ball marker secondary plates, the first ball marker secondary plate abutting the inside surface of the primary plate, the opposite surface of the first ball marker secondary plate abutting the surface of the bill of the ball cap, and the second ball marker secondary plate adapted to abut the outside surface of the primary plate relative to the bill of the ball cap;

c. a clip mechanism having spaced apart feet and affixed to the primary plate and arranged to create a tunnel space defining ends and with sufficient width and height behind the primary plate to accept the first ball marker secondary plate, the height of the tunnel space exposing the distance between surfaces of the back of the primary plate and the surface of the bill of the cap, the width of the tunnel space exposing the spaced apart inside edges of the clip mechanism feet, the tunnel space between the inside edges of the feet of the clip mechanism wide enough to accept said first ball marker secondary plate abutted to the back of the primary plate and adjacent the feet without touching the inside edges of the feet of the clip mechanism and the clip mechanism oriented to clip onto the bill of a ball cap;

d. a permanent magnet plate secured to the inside surface of the primary plate in the tunnel space, the magnetism of the magnet strong enough to permeate through the back of the non-ferrous primary plate to the front surface of the primary plate to attract and retain the second ball marker secondary plate on the outside front surface of the primary plate, the tunnel space being of sufficient height and width to receive from above or below the tunnel space the first or the second ball marker secondary plate, wherein the first or the second ball marker secondary plate is removable without the need to remove the retainer from the bill of the ball cap.

2. The device of claim 1, wherein the spaced apart feet of the mounting clip mechanism defining the tunnel comprise:

a. a first leaf adapted to extend under the bill of a cap;

b. a second leaf contiguous with the first leaf and adapted for abutting contact with the top of the bill of the cap;

c. a third leaf contiguous with the second leaf and affixed to the plate; and d. a tab extending from the third leaf and abutting the second leaf, thereby defining the height of the tunnel between the magnet and the surface of the bill of the ball cap;

wherein the tunnel is of sufficient width to receive the first ball marker secondary plate from either end of the tunnel space.

3. The device of claim 1, wherein the clip mechanism defines a fastening mechanism joined to the plate to lift the primary plate off the surface of the bill of the cap and to permanently attach to the surface of a bill of a ball cap.

4. The device of claim 1, wherein the primary plate is formed of a material selected from the group consisting of non-ferrous metals and metal alloys.

5. The device of claim 1, wherein the primary plate is formed of a material selected from the group consisting of polymers, polyolefins, polyamides, polyethylenes, polypropylenes, and copolymers and terpolymers thereof, and rubbery polymers.

6. The device of claim 1, wherein the clip mechanism is integrally formed with the plate.

* * * * *